United States Patent [19]

Annipajo et al.

[11] Patent Number: 4,637,658

[45] Date of Patent: Jan. 20, 1987

[54] CUTTERS FOR USE IN MINERAL MINING

[76] Inventors: Wolfgang Annipajo, Lunen; Oswald Breuer, Dortmund; Christoph Rassmann, Lunen, all of Fed. Rep. of Germany

[21] Appl. No.: 761,852

[22] Filed: Aug. 2, 1985

[30] Foreign Application Priority Data

Sep. 11, 1984 [DE] Fed. Rep. of Germany ..... 3433277

[51] Int. Cl.[4] ..... E21B 10/00

[52] U.S. Cl. ..... 299/79; 299/34; 299/36; 175/410

[58] Field of Search ..... 175/410; 299/32, 34, 299/36, 79; 76/101 A

[56] References Cited

U.S. PATENT DOCUMENTS

| | | | |
|---|---|---|---|
| 3,904,247 | 9/1975 | Ostrop | 175/410 X |
| 4,376,553 | 3/1983 | Breuer et al. | 175/410 X |
| 4,440,246 | 4/1984 | Jurgens | 175/410 X |

FOREIGN PATENT DOCUMENTS

| | | | |
|---|---|---|---|
| 1528599 | 5/1968 | France | 299/79 |
| 203039 | 8/1923 | United Kingdom | 175/410 |
| 300610 | 1/1970 | U.S.S.R. | 175/410 |

*Primary Examiner*—Stephen J. Novosad
*Assistant Examiner*—Michael A. Goodwin
*Attorney, Agent, or Firm*—Birch Thompson

[57] ABSTRACT

A floor cutter bit for a coal plough has a body carrying a pair of hard metal plates which define a coal face cutting edge and a floor cutting edge. A hard metal pin locates between the plates and receives end zones of the plates within recesses.

6 Claims, 2 Drawing Figures

CUTTERS FOR USE IN MINERAL MINING

FIELD OF THE INVENTION

The present invention relates to cutters for use with mineral winning machines, particularly coal ploughs, which strip mineral from a mineral face by skimming.

BACKGROUND TO THE INVENTION

Conventional coal ploughs employ a plurality of cutters or cutter bits supported by carriers or holders on a body of the plough. The cutters themselves are usually composed of a body onto which are mounted hardened metal plates and other inserts. In the case of floor cutters, the plates define coal and floor cutting edges—See for example German Utility Model No. 7506653. During use, the hardened plates of the floor cutters tend to break away at their adjacent end regions which necessitates replacement of the cutter.

A general object of the present invention is to provide an improved form of floor cutter.

SUMMARY OF THE INVENTION

A cutter in accordance with the invention employs a hard metal pin located between hard metal plates defining cutting edges. The plates and pin are mounted to a main body of the cutter. End zones of the plates fit into recesses in the pin. This arrangement avoids weakness at the transition between the plates and the pin. The cutting edges may extend perpendicular to abutting surfaces of the end zones and recesses while rear abutment faces of the plates inset into the body of the cutter extend parallel to the respective cutting edges. The recesses and end zones of the plate are preferably curvilinear inwardly of the body. The recesses have a depth approximating to the thickness of the plates. This preferably leaves additional abutment faces between the plates and the pin adjoining the recesses and ensures the pin is not weakened unduly by the presence of the recesses.

The invention may be understood more readily, and various other aspects and features of the invention may become apparent, from consideration of the following description.

BRIEF DESCRIPTION OF DRAWING

An embodiment of the invention will now be described, by way of example only, with reference to the accompanying draiwng, wherein.

DESCRIPTION OF PREFERRED EMBODIMENT

Figure 1:
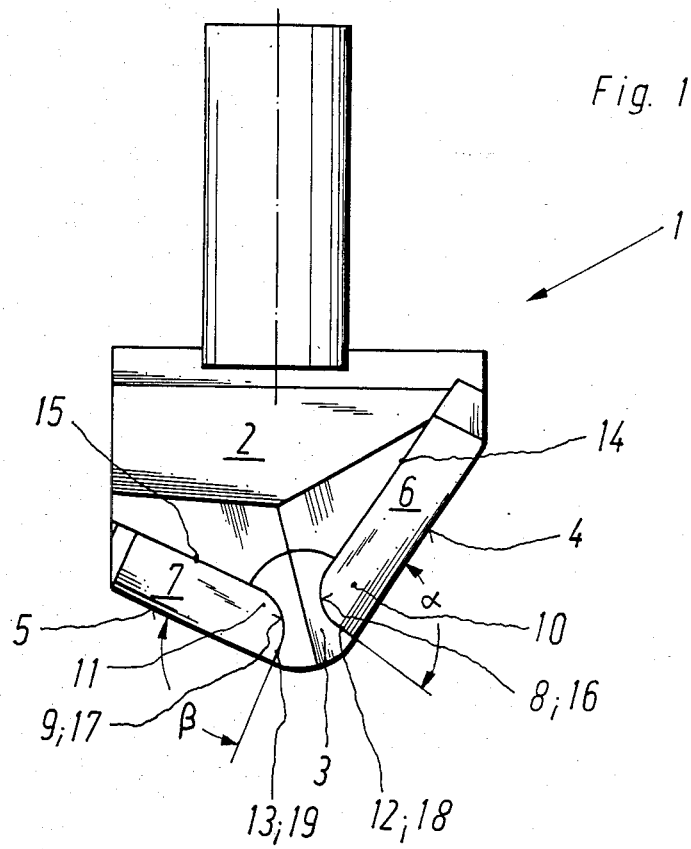
FIG. 1 is a side view of a cutter constructed in accordance with the invention.

As shown in the drawing, a cutter 1 usable particularly as a floor cutter of a coal plough has a body 2 with means, such as a shank as illustrated, for mounting to a carrier or the plough. To the body 2 there are mounted a pin 3 and two plates 6, 7. The pin 3 and the plates 6, 7 are made from hard metal.

Figure 2:
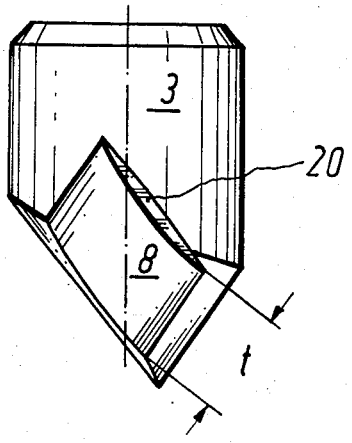
FIGS. 2 and 3 depict a pin used in the cutter shown in FIG. 1.
Figure 3:
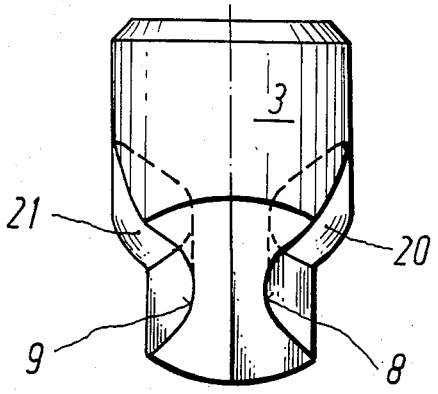

The pin 3 which is substantially cylindrical is illustrated separately in FIGS. 2 and 3. The pin 3 is located at the juncture between a cutting edge 4 intended to confront a mineral, e.g. coal, face and a cutting edge 5 intended to confront the floor of the mine working. The cutting edges 4, 5 are defined by the plates 6, 7. The pin 3 has curved recesses 8, 9 which receive corresponding shaped end zones 10, 11 of the plates 6, 7. The recesses 8, 9 do not weaken the pin 3 to any significant extend. The angles $\alpha$ and $\beta$ between the edges 4, 5 on the one hand and the outward projections of the abutting surfaces 18, 19 of the recesses 8, 9 and the end zones 10, 11 on the other hand are about 90°. The rear faces 14, 15 of the plates 6, 7 extend parallel to the edges 4, 5. The inner transition regions 16, 17 between the faces 14, 15 and the end faces 18, 19 of the plates 6, 7 are curved to match the recesses 8, 9.

As shown in FIG. 2, the depth t of the recesses 8, 9 correspond to the thickness of the plates 6, 7 and the plates 6, 7 are well supported on wall surfaces 20, 21 of the pin 3 adjacent the recesses 8, 9.

We claim:

1. A cutter for use with mineral mining machines; said cutter having a body, a pair of hard metal plates mounted to the body, the hard metal plates providing first and second cutting edges disposed exteriorly of the body, the first and second cutting edges lying in first and second planes, respectively, which are inclined to one another and intersect at a corner junction, a hard metal pin mounted to the body at the corner junction between said hard metal plates; wherein the pin merges smoothly with the cutting edges and is provided with circumferential recesses which receive and support adjacent end zones of the plates.

2. A cutter according to claim 1, wherein the recesses and end zones have respective mating end surfaces which extend substantially perpendicularly to the respective cutting edges.

3. A cutter according to claim 2, wherein the metal plates have rear faces abutting the body inwardly of the body, said rear faces extend parallel to the cutting edges and the recesses and the end zones of the plates are rounded off over transition regions with the rear faces.

4. A cutter according to claim 1, wherein the metal plates have rear faces abutting the body inwardly of the body and said rear faces extend parallel to the cutting edges.

5. A cutter according to claim 1, wherein the depth of the recesses corresponds to the thickness of the plates.

6. A cutter according to claim 5, wherein the recesses are bounded by walls of the pin which support the end zones of the plates.

* * * * *